US005331311A

United States Patent [19]

Doctor

[11] Patent Number: 5,331,311

[45] Date of Patent: Jul. 19, 1994

[54] RAILROAD WHEEL TEMPERATURE SENSOR WITH INFRARED ARRAY

[75] Inventor: Alan P. Doctor, Sea Cliff, N.Y.

[73] Assignee: Servo Corporation of America, Hicksville, N.Y.

[21] Appl. No.: 988,216

[22] Filed: Dec. 9, 1992

[51] Int. Cl.[5] ..... B60Q 1/22

[52] U.S. Cl. ..... 340/463; 340/584; 340/517; 340/600; 340/682; 246/169 A; 246/169 D; 246/169 R; 374/124; 374/129; 374/132; 374/2

[58] Field of Search ..... 340/463, 584, 682, 600, 340/517; 246/169 A, 169 D, 169 R; 374/124, 129, 121, 2, 128, 120, 126, 132, 173; 324/239; 250/342, 393

[56] References Cited

U.S. PATENT DOCUMENTS 2,818,508 12/1957 Johanson et al. .
3,253,140 5/1966 Sibley et al. .
3,461,284 8/1969 Joy ..... 246/169 A
3,545,005 12/1970 Gallagher .
3,812,343 5/1974 Gallagher et al. ..... 246/169 A
4,316,175 2/1982 Körber et al. ..... 340/682
4,812,826 3/1989 Kaufman et al. ..... 340/592
4,820,057 4/1989 Berndt ..... 374/129
4,878,761 11/1989 Dührkoop ..... 374/124
5,100,243 3/1992 Grosskopf et al. ..... 374/2
5,149,025 9/1992 Utterback et al. ..... 246/169 A
5,201,483 4/1993 Sutnar et al. ..... 246/169 A

*Primary Examiner*—John K. Peng
*Assistant Examiner*—Nina Tong
*Attorney, Agent, or Firm*—Kane, Dalsimer, Sullivan, Kurucz, Levy, Eisele and Richard

[57] ABSTRACT

A temperature sensor assembly for monitoring railroad car wheels includes an array of temperature detectors arranged to generate a temperature profile of the wheel. The array may be formed integrally with imaging elements and signal conditioning elements on a single IC chip. The assembly may be arranged to monitor the wheel either transversely or in parallel to the direction of wheel movement.

17 Claims, 4 Drawing Sheets

RAILROAD WHEEL TEMPERATURE SENSOR WITH INFRARED ARRAY

BACKGROUND OF THE INVENTION

A. Field of Invention

This invention pertains to a railroad wheel sensor and more particularly to a temperature sensor with a plurality of infrared detectors arranged in an array for detecting hot wheel flanges and/or hot wheel bearings.

B. Description of the prior art

A major source of problems in the field of railroad transportation and especially freight railroad trains have been overheated bearings. Am overheated bearing on a single car truck may collapse, causing the car to overturn and the train to derail. Such derailments are extremely dangerous, and can cause immense economic expense. In order to prevent such derailments, infrared hot bearing detecting apparatus are presently in service on railroads in virtually every major country in the world. The original system for these detectors was installed in the United States in 1956. Typically, such systems use an infrared scanner disposed on the railroad bed adjacent to the track and oriented at an angle upwardly so that it scans successively the bearing covers and the bottom of the railroad car. The readings obtained from the car bottom is used as an indicia of the ambient temperature. Over the years various changes have been made in the design of railroad cars and the detectors must have the ability to scan and accurately measure the temperature of the bearings on a large number of car configurations. Existing detectors have problems accomplishing this task successfully. For example, the latest articulated freight cars do not present a uniform bottom to the scanner which can be used as an accurate ambient temperature reference. Another problem with existing detectors has been that the bottom of empty freight cars may get heated up by the sun giving a false indication of the ambient temperature.

Another problem for railroads results from overheated wheels due to defective brake mechanisms. These mechanisms heat the wheels of a car to dangerous levels, causing the wheel flanges to lose their tensile strength. Of course the dangerous temperature limit for a hot wheel flange is much higher that the dangerous temperature limit for a hot bearing and therefore a temperature for a wheel flange may be perfectly acceptable but may be too high for a bearing. Until now this and other various physical constraints dictated the use of separate hot wheel flange and hot bearing detectors. In fact many hot bearing detectors included means for occluding any hot wheel flange readings to insure that a normal wheel flange reading does not result in a false hot bearing reading. Of course a false hot bearing reading (or for that matter, a false hot wheel flange reading), while not as dangerous, is also very expensive if it result in the stopping of a train. Moreover, existing detectors used only a single temperature sensor and required complicated circuitry to properly recognize a hot wheel flange or wheel bearing.

U.S. Pat. No. 2,818,508 to Johanson et al. discloses a hot bearing detector with a scanner oriented transversely to the train movement, and a wheel sensor which disables the scanner to insure that hot wheel readings are excluded.

U.S. Pat. No. 3,545,005 to Gallagher discloses a hot bearing detector with a mechanical shutter operated by a wheel.

U.S. Pat. No. 3,253,140 to Sibley et al. discloses a system with an angled detector for recording the temperature of a wheel hub, wheel web and wheel flange.

OBJECTIVES AND SUMMARY OF THE INVENTION

In view of the above-mentioned disadvantages of the prior art it is an objective of the present invention to provide a detector for monitoring railroad wheels faster and more accurately than prior art detectors.

A further objective is to provide a detector with multiple arrays which may be incorporated into detectors oriented to scan railroad wheels either in parallel with or transversal to the train movement.

Yet a further objective is to provide a detector which may be used for simultaneously monitoring both the flange and the bearing temperature of a railroad wheel.

Other objectives and advantages of the invention shall become apparent from the following description of the invention.

Briefly, a temperature sensor assembly for railroad wheels designed in accordance with this invention includes a detector array formed of a plurality of infrared temperature detectors generating temperature indicative signals. The assembly is arranged on a railroad right-of-way and is provided with imaging means for projecting the image of a moving railroad wheel on the detector array. The signals generated by the detector array define a temperature profile for the wheel. These signals are conditioned and fed to a processing means which analyzes the temperature profile of the wheel to detect a high temperature condition for the wheel. Depending on the arrangement of the detector array and its housing, the processing means detects a high wheel flange temperature condition, a high wheel bearing temperature condition or both. Preferably the imaging means, the array and the signal processing means are packaged in a single IC chip.

DETAILED DESCRIPTION OF THE INVENTION

Figure 1:
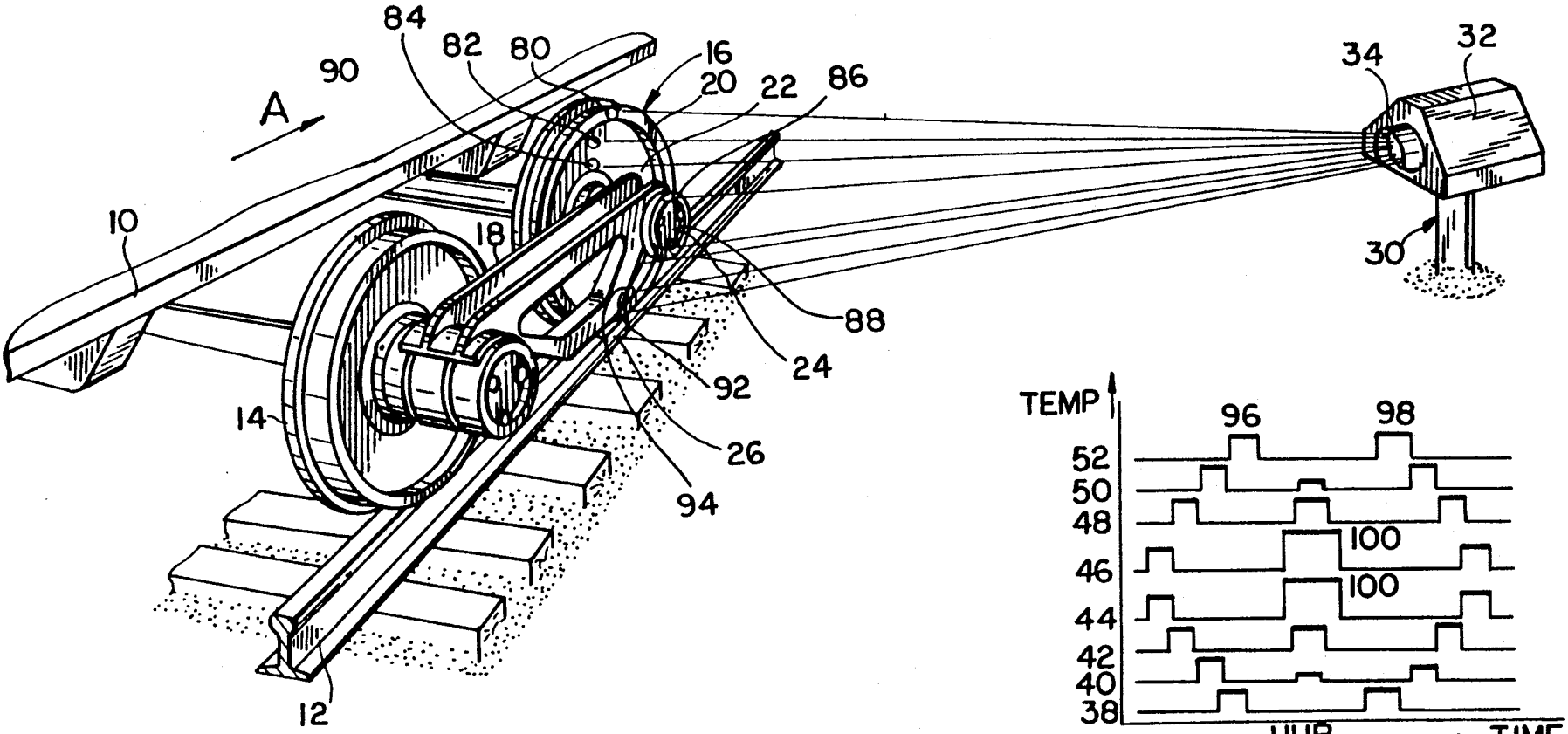
FIG. 1 shows an orthogonal view, somewhat schematic view of a detector constructed in accordance with this invention and scanning a moving railroad car.

In FIG. 1 a railroad car 10 is shown moving on rail 12 in the direction indicated by arrow A. The car 10 includes a pair of wheels 14, 16 mounted on a common truck 18. Wheel 16 includes a flange 20 joined by a web 22 to a hub 24. Hub 24 houses the wheel bearings (not shown). Wheel 16 is shown moving over a wheel detector 26 mounted on rail 12.

In the embodiment of FIG. 1, a wheel detector system is shown including an upright 30 disposed on the railroad right of way at a preset distance from rail 12. Upright 30 supports a housing 32 with a window 34 facing toward rail 12. The housing 32 contains a temperature sensor assembly for monitoring wheels 14, 16.

Figure 2:
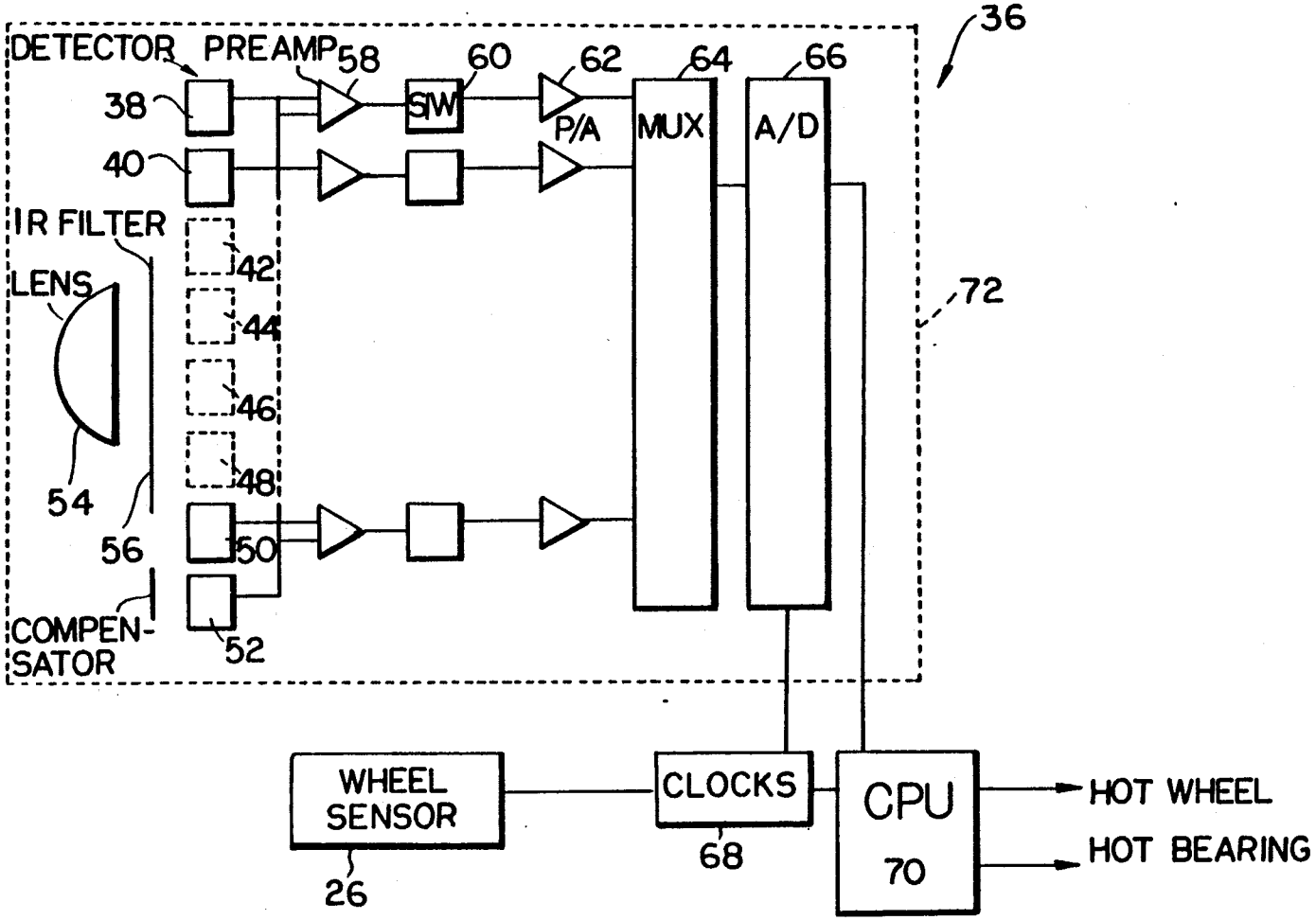
FIG. 2 shows a schematic diagram for the detector of FIG. 1.

As shown in FIG. 2, the temperature sensor assembly 36 disposed in detector housing 32 consists of a plurality of temperature detectors 38–52. Each detector consists of a pyroelectric IR temperature sensing element made for example of lithium tantalate crystals. This material is preferable because of its large pyroelectric current output, high temperature stability and Curie temperature to produce detectors with high sensitivity as well as consistent and stable performance. Each detector is disposed behind a lens 54. The lens is arranged to focus an image of a wheel 16 on the detectors 38–52 through an IR filter 56.

The output of detector 38 is fed to a preamplifier stage 58 which may consist of a hybridized JFET impedance buffering voltage preamplifier made integrally with the detector 38. The output of preamplifier 58 is monitored by a sample and hold (S/H) stage 60 and then fed to a second amplifier stage 62. Similar preamplifier, sample hold and amplifier stages are provided for each of the other detectors 40–52 as shown to provide signal conditioning and amplification. The outputs of each of the amplifier stages are fed to a multiplexer 64. Multiplexer 64 sequentially feeds these outputs to an A/D converter 66. Temperature sensor assembly 36 also includes wheel detector 26, a clock circuit 68 and a CPU 70. When detector 26 senses a wheel 16, it sends a signal to clock circuit 68 indicating the beginning of a wheel temperature sensing operation. Clock circuit 68 enables the A/D converter 66 and also sends various clocking signals to the CPU 70. The CPU 70 in response analyzes the readings from the detectors as provided by the A/D converter 66 and generates various wheel condition indication signals as described more fully below.

Figure 6:
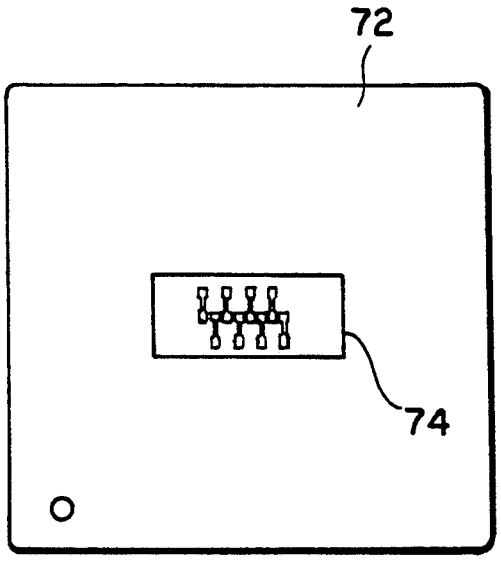
FIG. 6 shows a top view of a sensor array IC for the detector of FIGS. 1 and 4.
Figure 7:
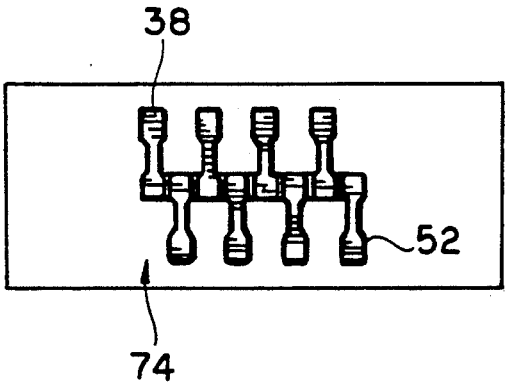
FIG. 7 shows an enlarged view of the IC chip showing the actual sensors.

The lens 54, filter 56, detectors 38–52 and other circuits described above up to the A/D converter 66 may be advantageously packaged into a single IC chip 72. As shown in FIG. 6, IC chip 72 may have a generally square shape with a window 74. The detector elements 38–52 are then arranged in an array under window 74. The array of detector element may be a linear array or any other two dimensional array. For example, in FIG. 7 detectors 38–52 are arranged in a 2×4 array with one row being off-set from the other.

Figure 3:
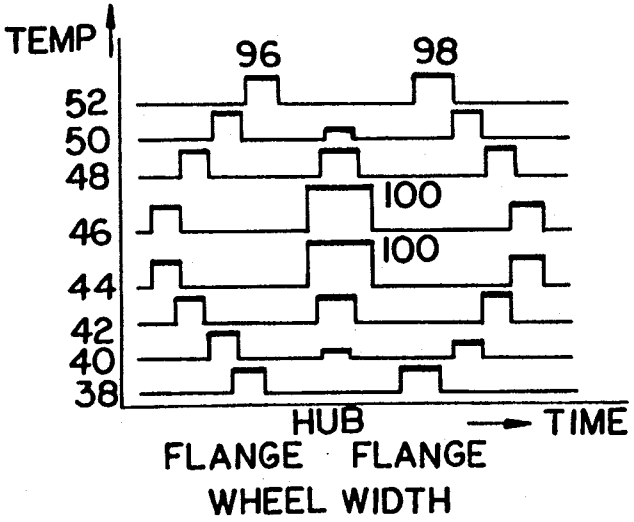
FIG. 3 shows a time chart of the signals generated by the detector of FIGS. 1 and 2 in response a train wheel.

The temperature sensor assembly 36 may be used in a wide variety of applications. For example the detectors may be arranged in the array of FIG. 7, as shown in FIG. 1, so that each of the detectors monitors the temperature of a corresponding zone 80–94 of a wheel. These zones extend along an oblique axis across the wheel 16 at an angle of about 22.5° from vertical. In this configuration, as wheel 16 moves past the housing 32, the detectors produce individual wave forms arranged to generate a two-dimensional temperature profile of the wheel as shown in FIG. 3. The two lateral peaks of each wave form, such as 96, 98 indicate the temperature of the flange 20 while the central peaks 100, especially from sensors 44 and 46 represent the temperature of the wheel hub 24. The wheel hub temperatures 100 are related to and are indicative of the condition of the wheel bearings. These waveforms are analyzed by CPU 70 in accordance with preselected criteria programmed into the CPU. Importantly, in the two dimensional temperature profile of wheel generated by the detectors, the wheel flange is easily separable from the temperature of the hub by the position of the respective peaks. If the CPU 70 determines that a wheel has an excessive wheel flange temperature it generates a hot wheel alarm. Similarly, if CPU determines that a wheel has an excessive bearing temperature based on the temperature of the wheel hub, it generates a hot bearing alarm.

Figure 4:
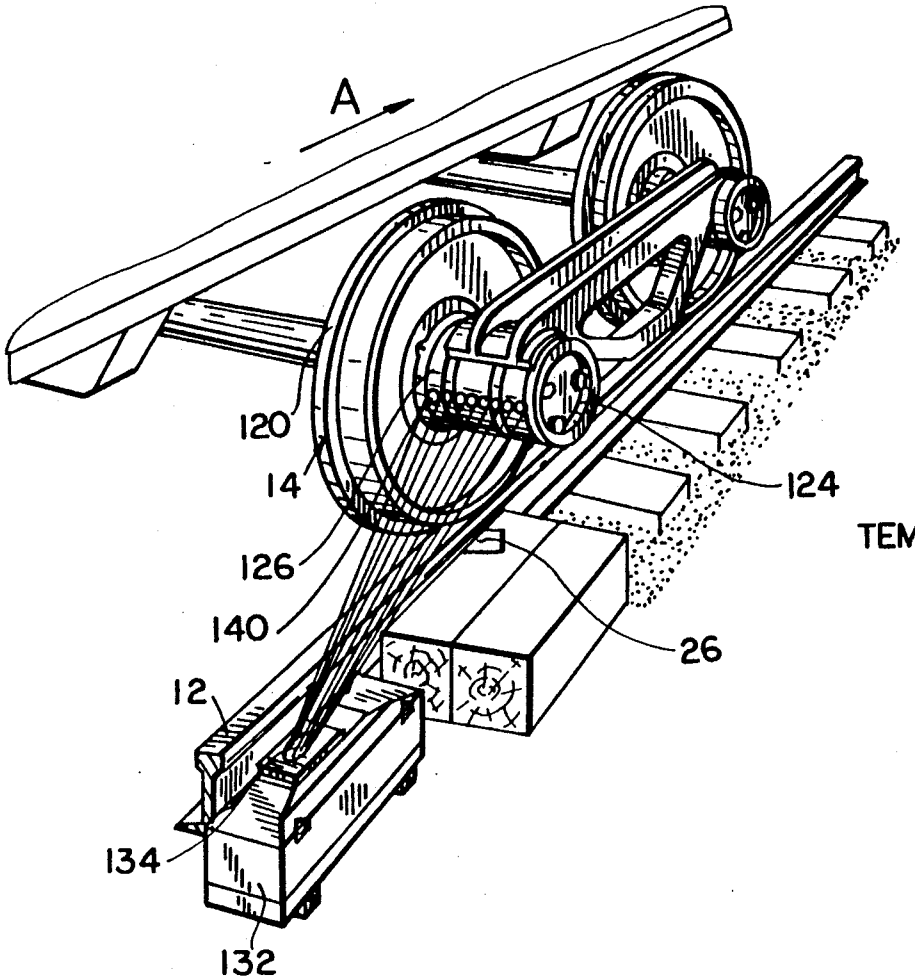
FIG. 4 shows an orthogonal, somewhat schematic view of an alternate embodiment.

In FIG. 4 an alternate embodiment of the invention is shown wherein a detector housing 132 is disposed adjacent to the rail 12. Housing 132 has a window 134 oriented to permit temperature sensor assembly 36 to look up at an angle in a direction parallel to the train movement A. Wheel 14 has a wheel hub 124 and a cylindrical bearing housing 126. Housing 126 is disposed coaxially with wheel flange 120. In this embodiment, the detector array monitors a plurality of zones 140 arranged axially along the wheel bearing housing 126 as shown. In this configuration the detectors 38–52 generate an axial temperature profile of wheel bearing housing shown in FIG. 5. The left most peak of this profile generate by detector 38 represents the inboard temperature while the right most peak generated by detector 52 represents the outboard temperature.

Figure 5:
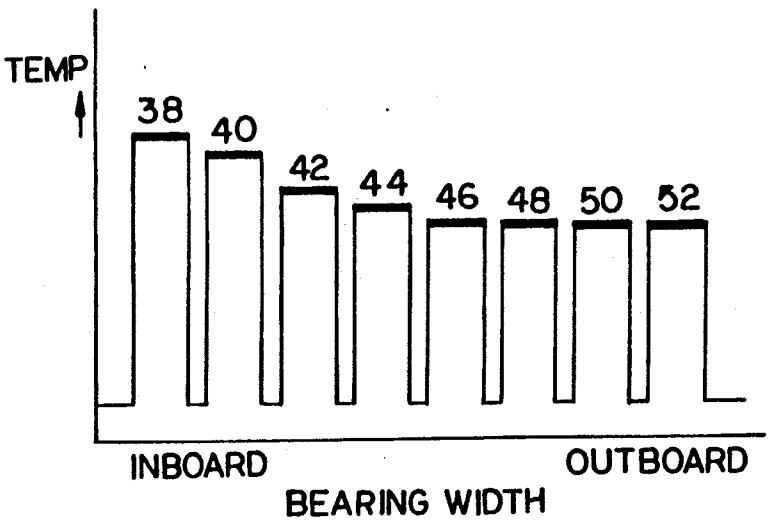
FIG. 5 shows a time chart of the signals generated by the alternate embodiment of FIG. 4.

CPU 70 analyzes the waveforms shown in FIG. 5 and if it senses a hot wheel bearing based on preselected criteria programmed into the CPU, it generates a hot bearing indication.

Obviously numerous modifications may be made to the invention without departing from its scope as defined in the appended claims.

I claim:

1. A wheel temperature sensor assembly for railroad systems for monitoring the temperature of the wheels of railroad cards, said assembly comprising:

projecting means for projecting an image of an railroad wheel portion;

a detector array consisting of a plurality of infrared temperature detectors, each detector generating a temperature indicative signal, said detector array receiving said image from said projecting means and generating a two-dimensional profile of said wheel portion; and processing means for processing said temperature indicative signals and for generating an alarm signal when said temperature indicative signals exceed a preselected limit characterizing an abnormal condition for said wheel.

2. The assembly of claim 1 further comprising a stationary housing for holding said detector array, said housing being arranged adjacent to a track for monitoring the wheel temperature of the wheel moving in a direction.

3. The assembly of claim 2 wherein said projecting means is arranged to monitor said wheel temperature along an axis transversal to said direction.

4. The assembly of claim 2 wherein said projecting means is arranged to monitor said wheel temperature along an axis parallel to said direction.

5. The assembly of claim 1 wherein said wheel includes a wheel bearing housing and wherein said detector array generates a temperature profile of said wheel bearing housing.

6. A temperature sensor assembly for monitoring the temperatures of the wheels of a railroad train moving in a direction, said sensor assembly comprising:

a stationary detector array consisting of a plurality of infrared temperature detector;

projecting means for projecting images of several wheel zones from a railroad wheel on said array, each detector generating a temperature indicative signal indicative of the temperature of one of said wheel zones to define a two-dimensional temperature profile of said wheel; and signal processing means for processing said temperature indicative signals, said signal processing means generating an alarm signal indicative of a high temperature associated with said wheel.

7. The assembly of claim 6 further comprising housing means for housing said array and said projecting means.

8. The assembly of claim 6 wherein said detector array and said signal processing means are constructed and arranged on a single integrated circuit.

9. The assembly of claim 6 wherein said projecting means is arranged to monitor said wheel along an axis transversal said direction.

10. The assembly of claim 6 wherein said imaging means is arranged to monitor said wheel along an axis parallel to said direction.

11. The assembly of claim 6 wherein said wheel includes wheel bearings and said processing means generates a hot wheel bearing alarm.

12. The assembly of claim 6 wherein said wheel has a wheel flange and said processing means generates a hot wheel flange alarm.

13. A temperature sensor assembly for monitoring the temperatures of the wheels of a railroad train moving in a direction on a track, said sensor assembly comprising:

a wheel detector disposed adjacent to said track for detecting said wheel and for generating a wheel present signal when said wheel is detected;

a stationary housing associated with said track;

a detector array disposed in said housing and including a plurality of infrared detectors;

projecting means disposed in said housing and arranged to project an image of said wheel moving on said track on said detector array, said infrared detectors generating temperature indicative signals defining a two dimensional temperature profile of said wheel; and processing means arranged to receive said temperature indicative signals and said wheel present signal and to generate an alarm indicative of a high temperature condition of said wheel.

14. The assembly of claim 13 further comprising amplifying means for amplifying said temperature indicative signals.

15. The assembly of claim 14 wherein said imaging means, said amplifying means and said detector array are constructed and arranged on a single integrated chip.

16. The assembly of claim 13 wherein said detector array is arranged to monitor said wheel along an optical axis transversal to said direction.

17. The assembly of claim 13 wherein said housing is disposed adjacent to said track and said detector array is arranged to monitor said wheel along an axis parallel to said direction.

* * * * *